US006202722B1

(12) United States Patent
Crocker

(10) Patent No.: US 6,202,722 B1
(45) Date of Patent: Mar. 20, 2001

(54) WHEELCHAIR CARRIER

(76) Inventor: William C. Crocker, 602 Excel Cir., Brownsboro, AL (US) 35741

( * ) Notice: Subject to any disclaimer, the term of this patent is extended or adjusted under 35 U.S.C. 154(b) by 0 days.

(21) Appl. No.: 09/303,933

(22) Filed: May 3, 1999

(51) Int. Cl.[7] ..... G65D 65/02
(52) U.S. Cl. ..... 150/154; 280/304.1; 280/304.5
(58) Field of Search ..... 150/154, 166, 150/167; 280/304.1, 304.5

(56) References Cited

U.S. PATENT DOCUMENTS

| | | | | |
|---|---|---|---|---|
| 663,306 | * | 12/1900 | Tompkins | 150/166 |
| 2,243,981 | * | 6/1941 | Rowan | 150/166 |
| 2,570,533 | * | 10/1951 | Elliott | 150/166 |
| 2,801,667 | * | 8/1957 | Curran | 150/166 |
| 3,886,988 | * | 6/1975 | Garrett et al. | 150/167 X |
| 4,244,411 | | 1/1981 | Karlstrom et al. . | |
| 4,356,831 | * | 11/1982 | Adams | 150/167 |
| 4,679,242 | | 7/1987 | Brockhaus | 150/154 |
| 4,693,289 | | 9/1987 | Taylor et al. | 280/304.1 |
| 4,715,646 | * | 12/1987 | Goffi et al. | 150/167 X |
| 4,795,207 | * | 1/1989 | Clarke | 150/166 |
| 4,944,340 | * | 7/1990 | Tortorich | 150/167 |
| 4,948,154 | | 8/1990 | Guggenheim | 150/154 X |
| 4,954,384 | | 9/1990 | Hartwell | 150/154 |
| 5,028,472 | | 7/1991 | Gray | 150/158 X |
| 5,170,826 | | 12/1992 | Carstensen et al. | 150/154 |
| 5,282,502 | * | 2/1994 | Ballard | 150/167 |
| 5,372,169 | * | 12/1994 | Norton et al. | 150/167 |

FOREIGN PATENT DOCUMENTS

| | | | | |
|---|---|---|---|---|
| 2253781 | * | 9/1992 | (GB) | 150/154 |

* cited by examiner

*Primary Examiner*—Sue A. Weaver
(74) *Attorney, Agent, or Firm*—Waddey & Patterson; John C. Garvin, Jr.

(57) ABSTRACT

A carrier for a collapsed wheelchair which allows a disabled person and persons of small stature to enclose and secure the collapsed wheelchair within the carrier and to lift and move the collapsed wheelchair with minimum ease. The carrier comprises a top and end panel member secured to a front panel and a rear panel to form a generally rectangular inverted housing with an opened bottom. An opened seam is formed adjacent the open bottom of the housing for receiving a drawstring which can be drawn to secure the collapsed wheelchair within the carrier.

17 Claims, 6 Drawing Sheets

WHEELCHAIR CARRIER

FIELD OF THE INVENTION

The present invention relates to improvements in wheelchair carriers or covers, and more particularly to new and improved carriers or covers into which a collapsed wheelchair may be placed for movement by a person or for transportation of the wheelchair by motor vehicle or during the storage of the wheelchair.

BACKGROUND OF THE INVENTION

The use of wheelchairs by elderly or disabled persons is widespread and well accepted and their use is likely to increase substantially due to the prolonged life expectancy and the general aging process of the population. Thus, there is an increasing need for collapsible wheelchairs and their accessories.

A collapsible wheelchair is a relatively expensive device having numerous moving and delicate parts. For these reasons, it is desirable to protect the wheelchair during transportation or storage and provide for easy movement of the collapsed wheelchair while in a carrier or cover therefor.

Frequently, a person confined to a wheelchair must be transported by motor vehicle from one location to another. Normally when this is done, the wheelchair is collapsed and placed within the trunk or back seat of an automobile. The lifting and movement of a collapsed wheelchair is very cumbersome and difficult for an able-bodied person and is almost impossible by a disabled person or by a person of small stature. Therefore, there is a need for a carrier, housing or cover for a collapsed wheelchair which permits a person to easily place the collapsed wheelchair within the carrier or housing and to lift the wheelchair with minimum ease.

A search of U.S. patents for wheelchair carriers or housings which are somewhat pertinent to applicant's invention produced the following U.S. patents: namely, U.S. Pat. No. 4,693,289 to Taylor et al. and U.S. Pat. No. 5,170,826 to Carstensen et al.

U.S. Pat. No. 4,693,289 to Taylor et al. is directed to a first embodiment of a wheelchair carrier comprised of a bottom section and a top section; the bottom section having four side walls and a floor for receiving a collapsed wheelchair rolled therein; the top section having four side walls and a top wall; and means for securing the bottom section to the top section. U.S. Pat. No. 4,693,289 to Taylor et al. is further directed to a second embodiment of the wheelchair carrier comprised of a housing having four side walls, a top wall and a floor, with one side wall being on three of its edges detachable to enable a collapsed wheelchair to be placed in the housing and being reattachable on three of its edges to the housing to enclose the collapsed wheelchair within the carrier. To move the carrier, once the wheelchair is placed therein, a person must reach around the carrier as no handles or the like are provided on the carrier.

U.S. Pat. No. 5,170,826 to Carstensen et al. is directed to a cover for a collapsed wheel chair and comprises a hood portion, having an upper end, two sides and a flap extending from one of the sides for receipt under the collapsed wheelchair and being extended to the other side, and for providing a strap for grasping and carrying the collapsed wheelchair within the cover.

These prior art carriers or housings for wheelchairs have presented numerous problems and disadvantages particularly when compared with the improved carrier or housing of the present invention and have not been widely accepted by the public. There is a need, therefore, for a relatively inexpensive carrier or housing for a collapsed wheelchair of simple construction which overcome the problems and disadvantages associated with the prior art carriers or housings for a collapsed wheelchair. The carrier or housing for wheelchair of the present invention fulfills these needs.

The present invention is directed to a simple, light-weight, housing for covering, carrying, and transporting a collapsed wheelchair. The present invention is not cumbersome and can be easily placed over, and removed from, a collapsed wheelchair, and can be easily grasped to carry the housing and the wheelchair therein for movement from one location to another. The present invention is also designed such that the four wheels of the collapsed wheelchair may extend outside of the housing so that the wheels can be used to roll the collapsed wheelchair within the housing for short distance. The present invention is further designed so that a drawstring can be pulled to tighten the lowermost part of the housing to lock the housing upon the collapsed wheelchair so that a person can easily grasp one or more handles on the interior of the housing to move or carry the housing and collapsed wheelchair therein into a motor vehicle or to another location.

SUMMARY OF THE INVENTION

In accordance with the present invention, a simple and inexpensive carrier or housing for a wheelchair is provided which allows disabled persons and persons of small stature to easily place the carrier or housing over the collapsed wheelchair and to lift the collapsed wheelchair within the carrier or housing with minimum ease. The wheelchair carrier or housing of the present invention generally comprises a top and side panel member secured to a front panel member and a rear panel member by any suitable means such as stitching, a drawstring or rope associated with the top and side panel member, the front panel and the rear panel. When assembled as generally described, the carrier or housing somewhat resembles an inverted generally oblong cylinder closed at its top and open at its bottom. The drawstring, rope or cord can be tightened or loosened to secure a collapsed wheelchair within the carrier or housing. Two rope or cord locks are provided for holding the drawstring or rope in its tightened condition when a collapsed wheelchair is secured within the carrier or housing. A strap or handle is provided on each of the top and side panel member, the front panel member and the rear panel member to allow a person to easily grasp one or two of the straps of the carrier with the collapsed wheelchair therein and move same with minimum ease.

Accordingly, it is an object of the present invention to provide a carrier or housing for a collapsed wheelchair which is well-suited for protection of the wheelchair and allows a disabled or small statured person to lift the wheelchair to move the wheelchair from one location to another.

It is another object of the present invention to provide a relatively inexpensive and simple carrier or housing for a collapsed wheelchair into which the collapsed wheelchair can be placed, lifted and moved with minimum ease.

It is a further object of the present invention to provide a relatively inexpensive and simple carrier or housing for a collapsed wheelchair which has a strap attached to each of the top and two sides of the carrier or housing to enable the carrier or housing with the collapsed wheelchair therein to be lifted and moved with minimum ease.

These objects as well as other objects of the present invention will become more readily apparent from the following description taken in conjunction with the accompanying drawings.

DESCRIPTION OF THE PREFERRED EMBODIMENT OF THE INVENTION

Figure 1:
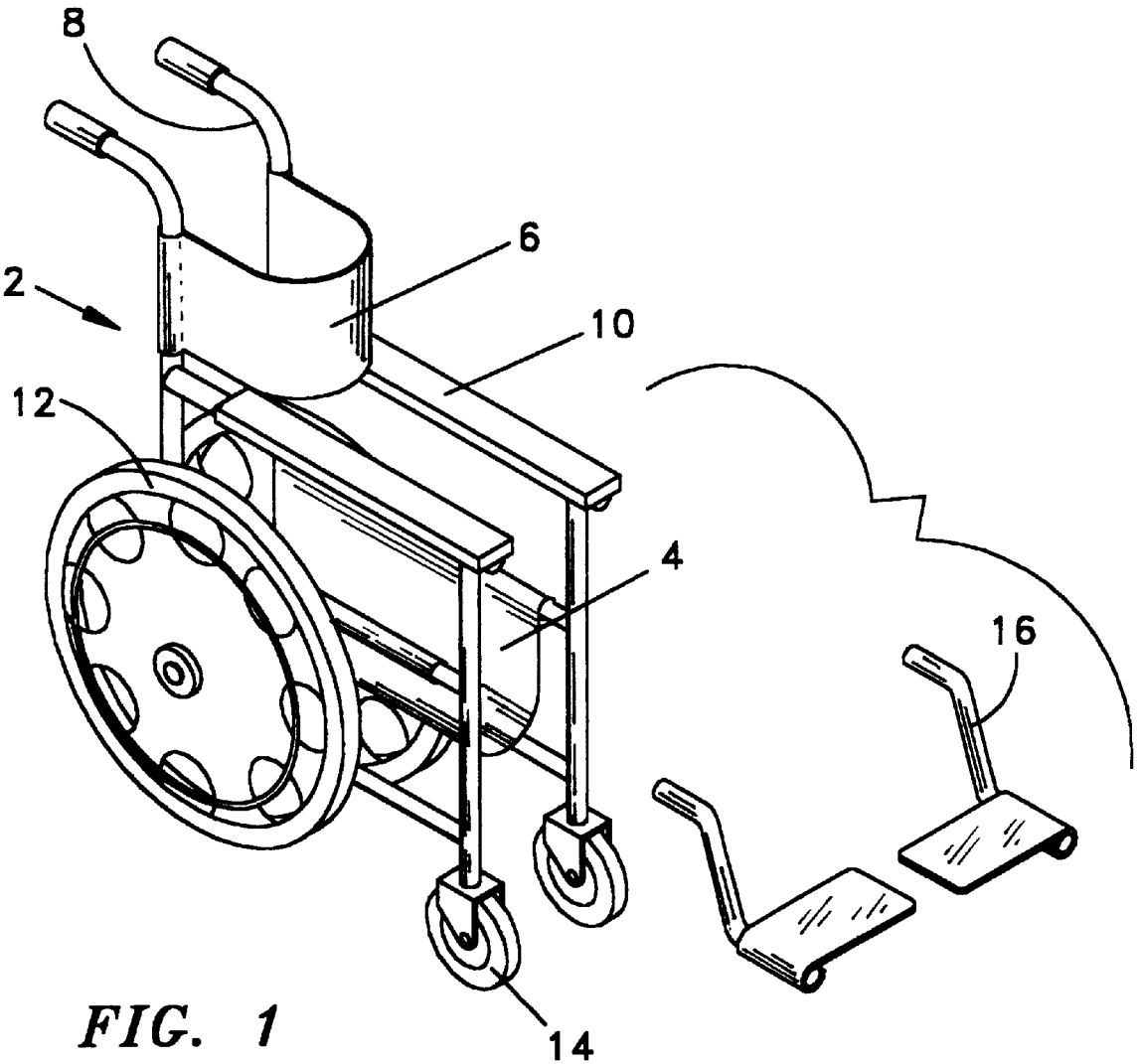
FIG. 1 is an exploded, perspective, view of a conventional collapsed wheelchair to be housed and/or carried by the wheelchair cover or carrier of the present invention.

Referring now to the drawings, reference numeral 20 generally designates the wheelchair carrier for a conventional wheelchair 2. As been seen in FIG. 1, conventional wheelchair 2 comprises a seat 4, a back 6, a pair of handles 8, a pair of side arm members 10, a pair of large rear wheels 12, a pair of small front wheels 14, and foot members 16 which may be detachably mounted to each of the side arm members 10 in a conventional fashion.

Figure 2:
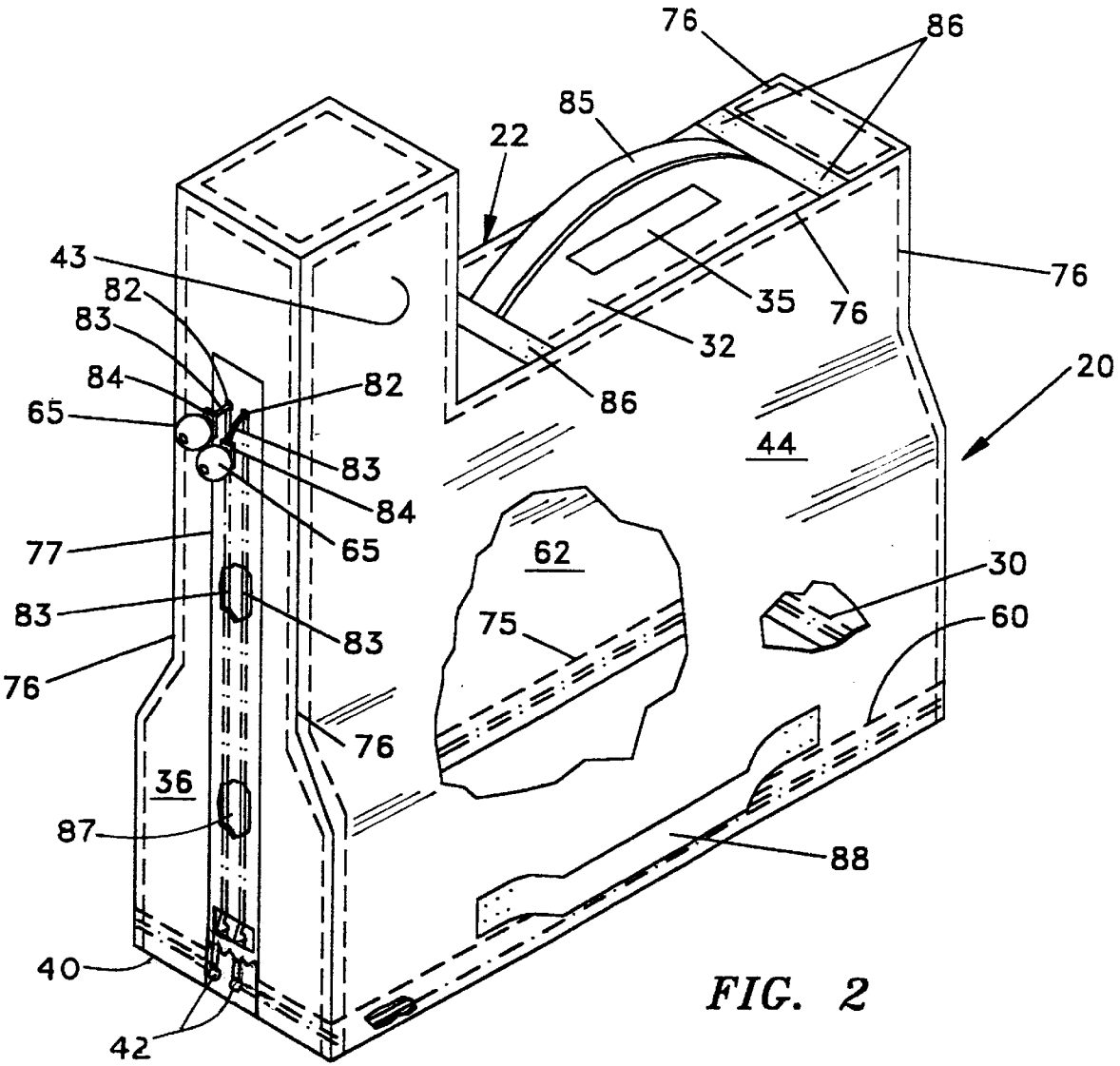
FIG. 2 is a partially broken away, perspective, view of wheelchair carrier of the present invention.
Figure 4:
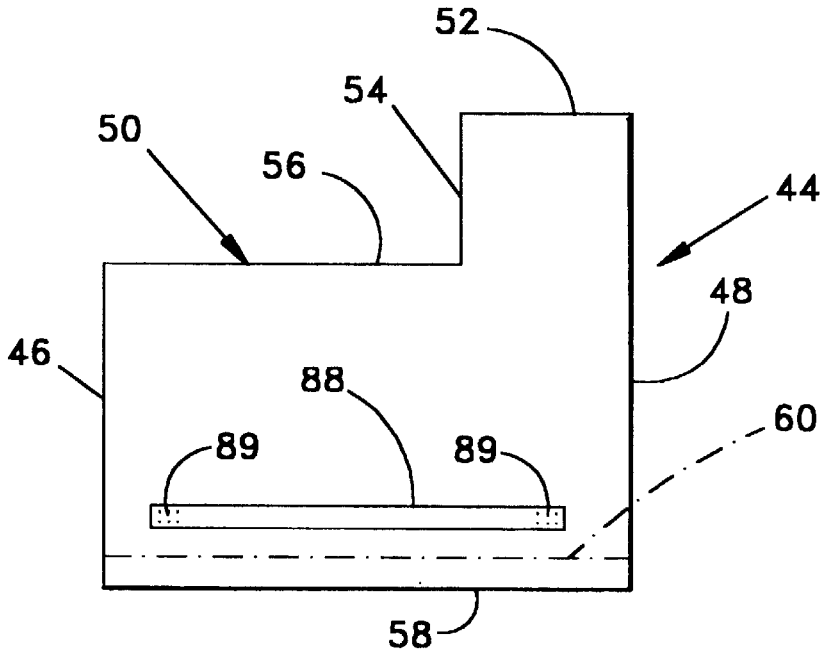
FIG. 4 is a side elevational view of the front panel of the wheelchair carrier of the present invention.
Figure 5:
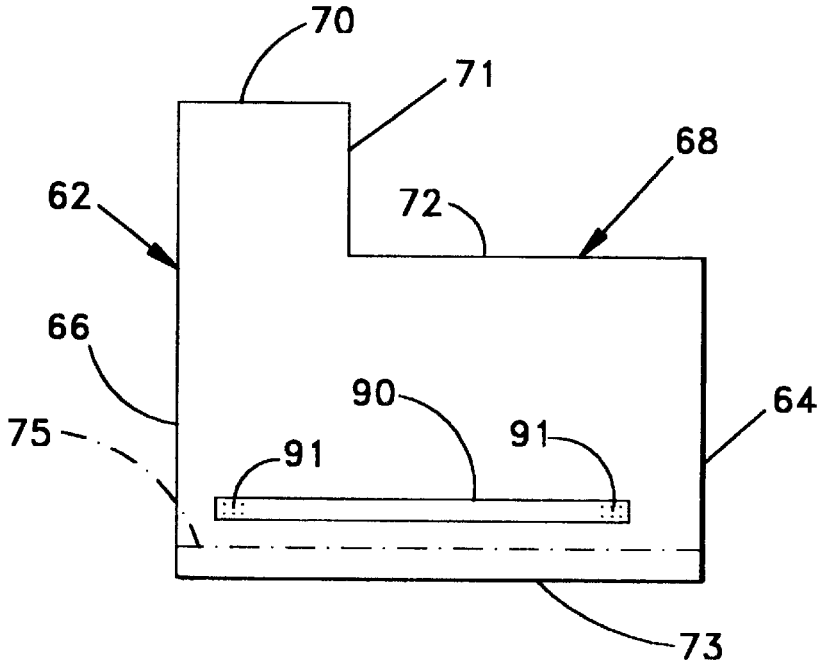
FIG. 5 is a side elevational view of the rear panel of the wheelchair carrier of the present invention.
Figure 6:
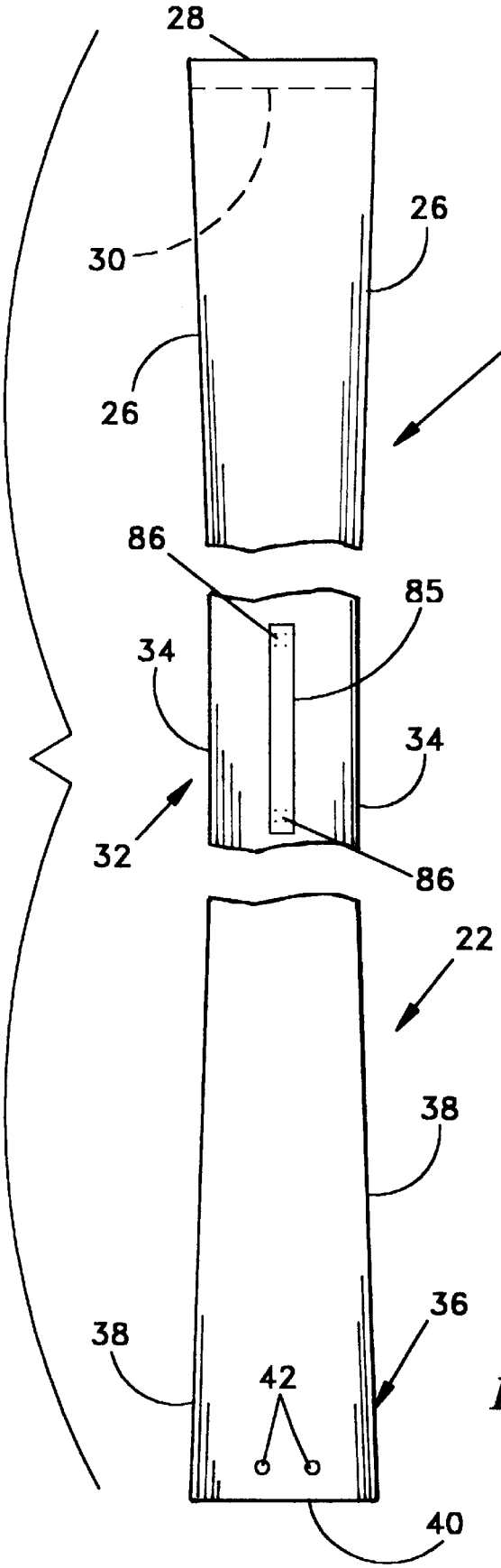
FIG. 6 is an exploded top plan view of the top and end panel of the wheelchair carrier of the present invention.
Figure 7:
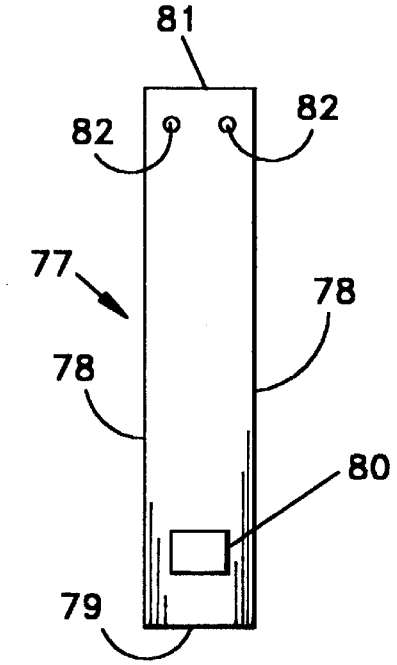
FIG. 7 is a side elevational view of the seam providing panel of the wheelchair carrier of the present invention.

Referring now to FIG. 2 of the drawings, wheelchair carrier 20 generally comprises a top and end panel 22, a front panel 44, a rear panel 62, a seam providing panel 77, a drawstring, rope or cord 83, a pair of rope or cord locks 84, and two knobs 65. As best seen in FIG. 6, top and end panel 22 includes a first end section 24 having a pair of side edges 26, an end edge 28 and a seam 30 adjacent end edge 28; an intermediate top section 32 having a pair of side edges 34 and a strip of VELCRO 35 (FIG. 2) secured thereto; and a second end section 36 having a pair of side edges 38, an end edge 40, and a pair of openings 42 adjacent end edge 40. As best seen in FIG. 4, front panel 44 includes a first side edge 46, a second side edge 48, a lower edge 58, a seam 60 adjacent the lower edge 58, and a top edge 50 having a stepped up or raised section 52, a step 54 and a lower or reduced section 56. As best seen in FIG. 5, rear panel 62, which is symmetrical with front panel 44, includes a first side edge 64, a second side edge 66, a lower edge 73, a seam 75 adjacent lower edge 73, and a top edge 68 having a stepped up or raised section 70, a step 71 and a lower or reduced section 72. As best seen in FIG. 7, seam providing panel 77 includes a pair of side edges 78, an upper edge 81, a pair of openings 82 adjacent upper edge 81, a lower edge 79, and an opening 80 adjacent lower edge 79. As best seen in FIG. 2, seam providing panel 77 is superimposed over a portion of second end section 36 and secured thereto by any suitable means such as stitching (not shown) to provide a gap or seam 87 between the outer surface of second end section 36 and the inner surface of seam providing panel 77 such that the two openings 42 in second end section 36 are in horizontal alignment with the seams 30, 60, and 75. Further, as best seen in FIG. 2, the lower edge 79 of seam providing panel 77 extends to the end edge 40 of second end section 36. A first strap or handle 85 (FIGS. 2 and 6) is attached by stitching 86 or other suitable conventional means to the intermediate top section 32 of carrier 20 and having a strip of VELCRO (not shown) secured to its underside for possible engagement with and disengagement from the VELCRO strip 35 (FIG. 2) on the upper surface of intermediate top section 32. A second strap or handle 88 (FIGS. 2 and 4) is attached by stitching 89 (FIG. 4) or other suitable conventional means to front panel 44 on the outer surface of front panel 44 adjacent the lower edge 58. A third strap or handle 90 (FIGS. 2,3 and 5) is attached by stitching 91 (FIG. 4) or other suitable conventional means to the lower edge 73 of rear panel 62.

Figure 3:
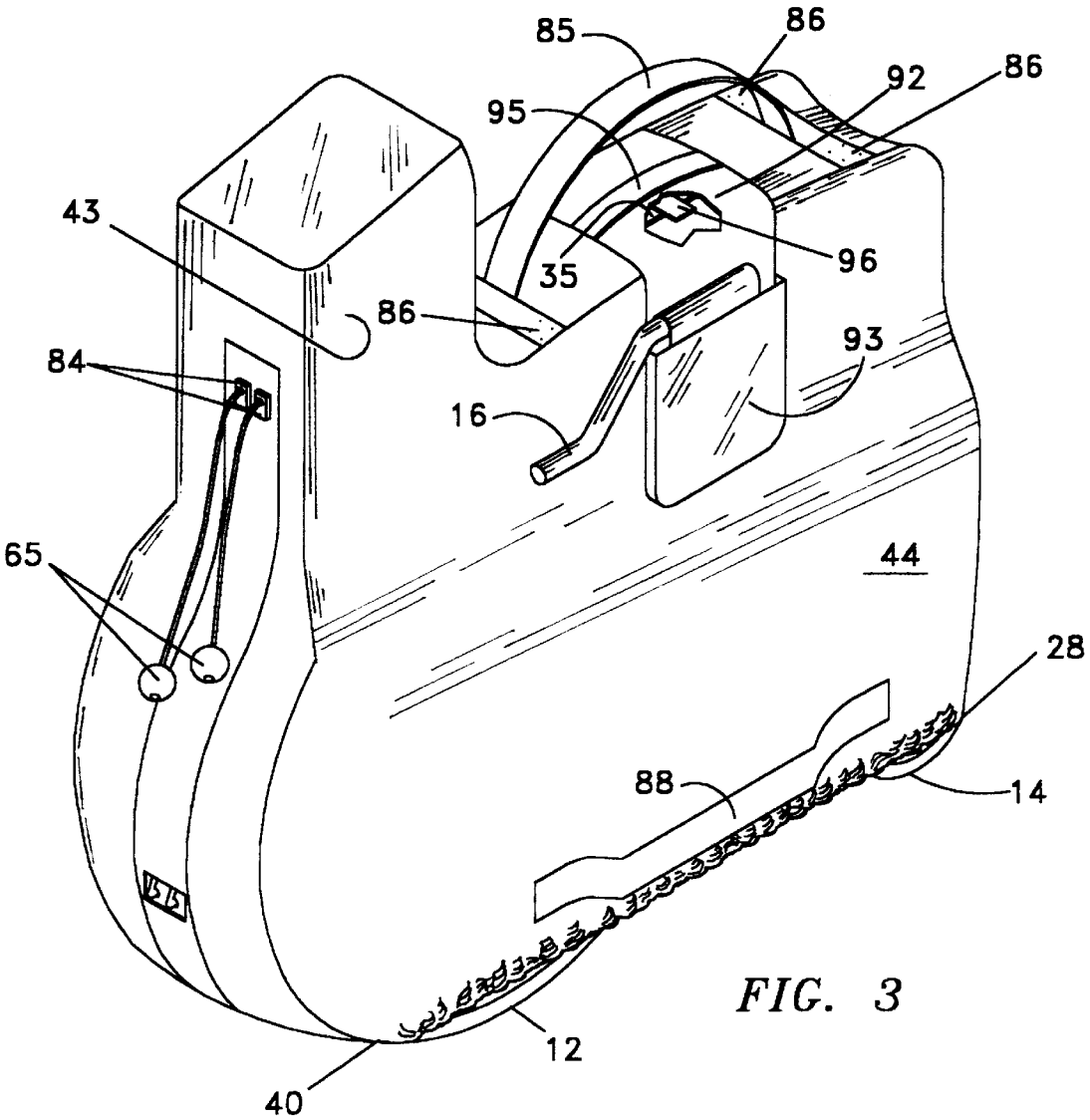
FIG. 3 is a partially broken away, perspective, view of the wheelchair carrier of the present invention having its drawstring tightened for securing a collapsed wheelchair therein and with the foot holder mounted thereon.
Figure 8:
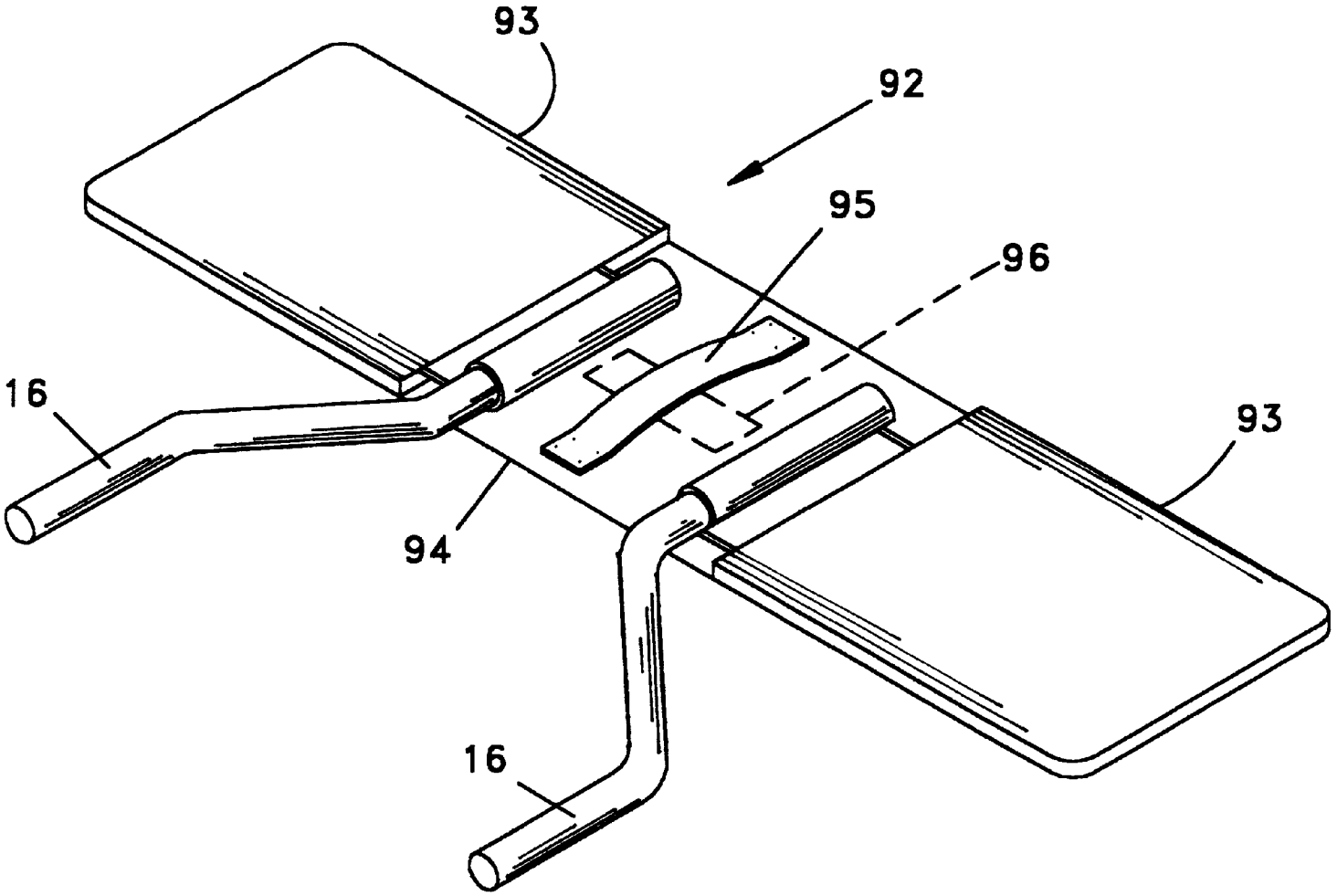
FIG. 8 is a perspective view of a holder for the foot members of the conventional wheelchair with portions of the foot members placed therein.

As best seen in FIGS. 3 and 8, numeral 92 generally designates a holder for the two foot members 16 of wheelchair 2. Holder 92 includes two end pockets 93 separated by an elongated intermediate section 94 having a handle member 95 on its upper side and a VELCRO strip 96 (FIG. 8) on its lower side for possible engagement with VELCRO strip 35 on intermediate top section 32 of top and end panel 22 of carrier 20.

Carrier 20 is assembled by securing by any conventional means such as stitching 76 (FIG. 2) the side edges 26 of the first end section 24 of top and end panel 22 to respective first side edges 46 and 64 of front panel 44 and rear panel 62; a portion of the side edges 34 of intermediate top section 32 of top and end panel 22 to respective lower sections 56 and 72 of front panel 44 and rear panel 62; a portion of the side edges 34 of intermediate top section 32 of top and end panel 22 to respective steps 54 and 71 of front panel 44 and rear panel 62; a portion of the side edges 34 of intermediate top section 32 of top and end panel 22 to respective stepped up sections 52 and 70 of front panel 44 and rear panel 62; the side edges 38 of second end section 36 of top and end panel 22 to respective second side edges 48 and 66 of front panel 44 and rear panel 62; and the side edges 78, lower edge 79 and upper edge 81 of seam providing panel 77 to the second end section 36 of top and end panel 22.

When assembled as explained hereinabove, and as best seen in FIG. 2, the seams 30, 60 and 75 and the openings 42 in second end section 36 are in alignment for receiving drawstring or rope 83. When the ends of rope or cord 83 exits the ends of the seams 60 and 75, they are directed through openings 42 of second end section 36 of top and end panel 22 and the gap or seam 83 (FIG. 2) formed between the second end section 36 of top and end panel 22 and through the openings 82 adjacent upper edge 81 of seam providing panel 77. A rope or cord lock or closure 84 is provided on each end of drawstring or rope 83 to keep the drawstring or rope 83 in a tightened condition when a collapsed wheelchair 2 is enclosed within carrier or housing 20. A reinforcement strip (not shown) can be placed within the stitching 76 (FIG. 2) connecting the top and end panel 22, the front panel 44 and the rear panel 62 of carrier or housing 20 for strengthening purposes. Cord or rope locks 84 are readily available from several sources, and it has been found that Part Nos. 350-0000, 302-0000 and 930-1001 manufactured and sold by ITW Nexus, 195 Algonguin Road, Des Plaines, Ill. 60016 are suitable for this purpose.

In operation, the carrier 20 is placed over an upstanding collapsed wheelchair 2 such that the handles 8 of wheelchair 2 are received within the hump 43 (FIG. 2) of carrier 20 and the end edges 28 and 40 of top and end panel 22 and the lower edges 58 and 73 of front and rear panels 44 and 62 respectively are adjacent the lowermost portions of the wheels 12 and 14 of collapsed wheelchair 2. A person would then pull on the knobs 65 on each end of drawstring or rope 83 until such time that the end edges 28 and 40 (FIG. 3) of top and end panel 22 tightly engages the outer surface of the wheels 12 and 14 of upstanding collapsed wheelchair 2. A person would then move the rope locks 84 along the drawstring or rope 83 until the rope locks 84 rest against the walls of respective openings 82 of seam providing panel 77 to secure the upstanding collapsed wheelchair 2 within the carrier 20 as shown in FIG. 3. A person can then grasp only the first strap 85, or both the first strap 85 and the second strap 88, or both the first strap 85 and the third strap 90 to easily lift and move the carrier 20 and the collapsed wheelchair 2 therein from one location to another.

The top and end panel 22, the front panel 44 and the rear panel 62 of carrier 20 can be made from any suitable material which is durable such as POLYDUCK, canvas, nylon or rayon. The straps or handles 85, 88 and 90 can also be made from any suitable webbed material such as POLYDUCK, canvas, nylon or rayon.

Although I have shown the specific construction and arrangement of parts and features constituting the preferred embodiment of my invention, changes or modification may be made in the parts and features without departing from the proper scope and fair meaning of the accompanying claims and without affecting the operations of the invention. For example, the first end section 24, the intermediate top section 32, and the second end section 36 of top and end panel 22 could be made in three separate pieces and stitched together rather than be of an integral piece.

I claim:

1. A carrier for a collapsed wheeled device, the device including a seat, a back, a pair of side arms, a pair of handles, a pair of foot members, and at least two wheels extending from each side arm in spaced relation to each other, the carrier comprising:

a top and end panel including a first end section having a first seam therein, an intermediate section and a second end section;

a front panel including a lower section having a second seam therein in communication with said first seam in said first end section of said top and end panel;

a rear panel including a lower section having a third seam therein in communication with said first seam in said first end section of said top and end panel;

means associated with said first, second and third seams for securing the collapsed wheeled device within the carrier, said means includes a drawstring within said first, second and third seams; and a first strap anchored to said top and end panel and a second strap anchored to said front panel to aid in the lifting and movement of the carrier and collapsed wheeled device.

2. A carrier for a collapsed wheeled device as set forth in claim 1 wherein a hump is formed in said top and end panel for receiving the handles of the wheeled device.

3. A carrier for a collapsed wheeled device as set forth in claim 2 wherein said means for securing said wheeled device within the carrier further includes a panel secured to said second end section of said top and end panel for providing a fourth seam in communication with said first, second and third seams and pair of lock means for keeping said drawstring tight when the wheeled device is secured within the carrier.

4. A carrier for a collapsed wheeled device as set forth in claim 5 wherein each of said first and second end sections of said top and end panel includes a lower edge for engaging the wheels of the wheeled device for retaining and securing the wheeled device within the carrier.

5. A carrier for a wheeled device as set forth in claim 1 wherein a third strap is anchored to said rear panel to aid in the lifting and movement of the carrier and collapsed wheeled device.

6. A carrier for a wheeled devise as set forth in claim 1 wherein said carrier further includes means for holding the foot members of the wheeled device when the wheeled device is in a collapsed, stored, condition.

7. A cover for a collapsible wheeled device, the device including a body, a pair of handles, and at least two wheels extending from a lower portion of the body in spaced relation to one another for supporting and transporting the body, the cover comprising:

a top member;

a first end section having a first seam therein;

a second end section having a pair of openings therein;

a front panel including a lower section having a second seam therein;

a rear panel including a lower section having a third seam therein;

means for securing said top member to said first end section, said second section, said front panel and said rear panel;

means for securing said first end section to said front panel and said rear panel;

means for securing said second end section to said front panel and said rear panel; and means associated with said first, second and third seams for securing the collapsible wheeled device within the cover.

8. A cover for a collapsible wheeled device as set forth in claim 7 wherein said means for securing the collapsible wheeled device within the cover includes a drawstring within said first, second and third seams.

9. A cover for a collapsible wheeled device as set forth in claim 8 wherein a first strap is anchored to said top member and a second strap is anchored to said front panel to aid in the lifting and movement of the cover and collapsible wheeled device.

10. A cover for a collapsible wheeled device as set forth in claim 9 wherein a hump is formed in said top member for receiving the handles of the wheeled device.

11. A cover for a collapsible wheeled device as set forth in claim 10 wherein said means for securing said wheeled device within the cover further includes a panel secured to said second end section for providing a fourth seam in communication with said first, second and third seams and pair of lock means for keeping said drawstring tight when the wheeled device is secured within the cover.

12. A cover for a collapsible wheeled device as set forth in claim 11 wherein each of said first and second end sections includes a lower edge for engaging the wheels of the wheeled device for retaining and securing the wheeled device within the cover.

13. A cover for a wheeled device as set forth in claim 12 wherein a third strap is anchored to said rear panel to aid in the lifting and movement of the cover and collapsible wheeled device.

14. A cover for a collapsed wheeled device, the device including a body, a pair of handles, and at least two wheels extending from the lower portion of the body in spaced relation to each other, the cover comprising:

a top and end panel including a first end section having a first seam therein, an intermediate section and a second end section;

a front panel including a lower section having a second seam therein in communication with and in horizontal alignment with said first seam in said first end section of said top and end panel;

a rear panel including a lower section having a third seam therein in communication with and in horizontal alignment with said first seam in said first end section of said top and end panel;

means associated with said first, second, and third seams for securing the collapsed wheeled device within the cover, said means includes a drawstring within said first, second and third seams; and at least one strap anchored to said cover to aid in the lifting and movement of the cover and collapsed wheeled device.

15. A cover for a collapsible wheeled device as set forth in claim 14 wherein said second end section of said top and end panel has a pair of openings therein which are in substantial horizontal alignment with said first, second and third seams and disposed for receiving said drawstring and wherein said means for securing said wheeled device within the cover further includes a panel superimposed over and secured to a portion of said second end section for providing a fourth seam in communication with said first, second and third seams and a pair of lock means for keeping said drawstring tight when the wheeled device is secured within the cover.

16. A cover for a wheeled device as set forth in claim 15 wherein said fourth seam is in vertical alignment with said openings in said second end section and wherein at least one additional strap is anchored to the cover to aid in the lifting and movement of the cover and collapsible wheeled device.

17. A cover for a collapsible wheeled device as set forth in claim 14 wherein each of said first and second sections includes a lower edge for engaging the wheels of the wheeled device for retaining and securing the wheeled device within the cover.

* * * * *